US010638913B2

(12) United States Patent
Gerstner et al.

(10) Patent No.: US 10,638,913 B2
(45) Date of Patent: May 5, 2020

(54) LOWER RACK FOR A DOMESTIC DISHWASHER HAVING A LOWER-RACK RAISING MEANS

(71) Applicant: BSH Hausgeräte GmbH, Munich (DE)

(72) Inventors: Norbert Gerstner, Herbrechtingen (DE); Julia Hörsch, Heidenheim (DE); Ersin Isbilen, Lauingen (DE); Thomas Ott, Neubiberg (DE); Thomas Steck, Holzheim (DE); Ralf Winkler, Wittislingen (DE)

(73) Assignee: BSH Hausgeräte GmbH, Munich (DE)

( * ) Notice: Subject to any disclaimer, the term of this patent is extended or adjusted under 35 U.S.C. 154(b) by 157 days.

(21) Appl. No.: 15/533,659

(22) PCT Filed: Dec. 15, 2015

(86) PCT No.: PCT/EP2015/079712
§ 371 (c)(1),
(2) Date: Jun. 7, 2017

(87) PCT Pub. No.: WO2016/102234
PCT Pub. Date: Jun. 30, 2016

(65) Prior Publication Data

US 2017/0332879 A1 Nov. 23, 2017

(30) Foreign Application Priority Data

Dec. 22, 2014 (DE) ..... 10 2014 226 820

(51) Int. Cl.
*A47L 15/50* (2006.01)
*A47L 15/42* (2006.01)

(52) U.S. Cl.
CPC ..... *A47L 15/504* (2013.01); *A47L 15/4202* (2013.01); *A47L 15/4229* (2013.01);
(Continued)

(58) Field of Classification Search
None
See application file for complete search history.

(56) References Cited

U.S. PATENT DOCUMENTS 5,115,822 A 5/1992 Nichols
6,247,771 B1 6/2001 Miller
(Continued)

FOREIGN PATENT DOCUMENTS

DE 102012107993 A1 3/2014
EP 1066789 A1 1/2001
(Continued)

OTHER PUBLICATIONS

JP 2004000745 translation (Year: 2004).*
(Continued)

*Primary Examiner* — Jason Y Ko
(74) *Attorney, Agent, or Firm* — Michael E. Tshupp; Andre Pallapies; Brandon G. Braun

(57) ABSTRACT

A lower rack for a domestic dishwasher is constructed for being liftable and includes a fixed lower rack element, and a removable lower rack element connectable to the fixed lower rack element and constructed for removal from the fixed lower rack element to thereby unblock access to a bottom area of a washing container of the domestic dishwasher.

19 Claims, 15 Drawing Sheets

(52) U.S. Cl.
CPC ..... *A47L 15/502* (2013.01); *A47L 15/503* (2013.01); *A47L 15/506* (2013.01); *A47L 15/507* (2013.01)

(56) References Cited

U.S. PATENT DOCUMENTS

| | | | | |
|---|---|---|---|---|
| 6,571,965 | B1 * | 6/2003 | Beck | A47L 15/503 211/41.8 |
| 8,550,592 | B2 | 10/2013 | Usuda et al. | |
| 9,282,877 | B2 * | 3/2016 | Fischer | A47L 15/50 |
| 2003/0042825 | A1 * | 3/2003 | Welch | A47L 15/504 312/228.1 |
| 2010/0078048 | A1 | 4/2010 | Schessl et al. | |
| 2010/0314977 | A1 | 12/2010 | Mallory et al. | |
| 2012/0074080 | A1 | 3/2012 | Garcia et al. | |
| 2013/0247944 | A1 * | 9/2013 | Fischer | A47L 15/50 134/164 |

FOREIGN PATENT DOCUMENTS

| | | | |
|---|---|---|---|
| EP | 2818092 | A1 | 12/2014 |
| JP | 2000000201 | A | 1/2000 |
| JP | 2001224547 | A | 8/2001 |
| JP | 2004000745 | A | 1/2004 |
| JP | 2006141515 | A | 6/2006 |
| JP | 2006141516 | A | 6/2006 |
| JP | 2006141526 | A | 6/2006 |
| JP | 2009285243 | A | 12/2009 |
| WO | 2005104924 | A1 | 11/2005 |
| WO | 2014102367 | A1 | 7/2014 |
| WO | 2014102374 | A1 | 7/2014 |

OTHER PUBLICATIONS

National Search Report DE 10 2014 226 820.6 dated Aug. 20, 2015.
International Search Report PCT/EP2015/079712 dated Mar. 15, 2016.

* cited by examiner

LOWER RACK FOR A DOMESTIC DISHWASHER HAVING A LOWER-RACK RAISING MEANS

CROSS-REFERENCES TO RELATED APPLICATIONS

This application is the U.S. National Stage of International Application No. PCT/EP2015/079712, filed Dec. 15, 2015, which designated the United States and has been published as International Publication No. WO 2016/102234 A1 and which claims the priority of German Patent Application, Serial No. 10 2014 226 820.6, filed Dec. 22, 2014, pursuant to 35 U.S.C. 119(a)-(d).

BACKGROUND OF THE INVENTION

The present invention relates to a lower rack for a domestic dishwasher having a lower-rack raising means and to a domestic dishwasher comprising the lower rack.

Domestic dishwashers have functional units that are provided on the container bottom of the washing container of the respective domestic dishwasher and at certain intervals have to be inspected, maintained or, if required, repaired. For example, a reservoir provided for the purpose regularly has to be refilled with regenerating salt; sieves and/or spraying devices, in particular spray arms, have to be cleaned and much repair work requires access to the container bottom of the washing container.

Conventional domestic dishwashers have lower racks positioned on rollers that are easy to remove from the washing container as required, thus unblocking access to the container bottom of the washing container.

However, various sliding/pivoting mechanisms for raising the lower rack from a lower position inside the washing container into an upper position outside the washing container for ease of loading are also known from the prior art.

Published document DE 10 2012 107 993 A1 discloses a sliding/pivoting mechanism of a shelf of a furniture item or of a domestic appliance for extending and raising the shelf out of a carcass of the furniture item or of the domestic appliance. It has at least two pivoting arms arranged so as to be rotatably fixed to at least one of the side walls of the carcass, with a first end parallel to the plane of the side walls, and spaced apart parallel to each other, it being possible for a guide rail to be fixed pivotably to respective second ends of the pivoting arms parallel to the plane of the side walls in such a way that said guide rail can be pivoted from a lower position inside the carcass into a raised, upper position at least partially outside the carcass. At least one linearly displaceable roller rail to which the shelf is fastened is arranged in the guide rail. The sliding/pivoting mechanism has a stopping mechanism arranged on the guide rail and on one of the pivoting arms in order to prevent a simultaneous pivoting and sliding movement of the roller rail.

Published document DE 20 2009 004 771 U1 discloses a device for adjusting the height of a shelf within a domestic appliance guided via at least one pull-out guide. The device has at least one roller rail upon which a shelf can be guided and removed in a pull-out direction, and a height-adjusting mechanism that can be fixed on opposing side walls of the domestic appliance. The height-adjusting mechanism in turn has two arms that are arranged so as to be rotatably fixed to each of the side walls and spaced apart parallel to each other, with a first end parallel to the plane of the side walls. Here, two guide rails can be pivotably fixed to respective second ends of the arms parallel to the plane of the side walls in such a way that the guide rails can be raised from a lower position inside the domestic appliance into a raised, upper position at least partially in front of the domestic appliance. An energy storage device that can be fixed onto at least one of the opposing side walls of the domestic appliance is in operative connection with one of the arms fixed to this side wall in such a way that raising and/or lowering of the guide rails can be assisted by the energy stored in the energy storage device.

Published document EP 2 818 092 A1 discloses a dishwasher that comprises a washing container and at least one crockery basket arranged within the housing. At least one rail is arranged on an inner wall of the housing for the purpose of guiding the at least one crockery basket forwards or backwards within the housing. Furthermore, at least one connecting unit is provided in order that the crockery basket can be raised. Here, at least one auxiliary unit is connected to the connecting unit, so that lift is exerted on the crockery basket.

Published document WO 2014/102367 A1 discloses a dishwasher comprising a washing container and a container door that makes access to the washing container possible, as well as a lower crockery basket and an upper crockery basket in which various objects can be arranged. A holder is provided that is connected to the two side walls of the washing container in such a way that it can be moved into and out of the washing container, both between a horizontal and a vertical position in a front area by means of rotation within a plane parallel to the side walls, and toward the back. The lower crockery basket is displaceable both horizontally by means of the holder and, when positioned vertically within the washing container, can be locked in place, also by means of the holder. Furthermore, a raising mechanism is provided that is arranged on both side walls of the washing container and that enables the holder, together with the lower crockery basket, to move rectilinearly between a lower position on the inner surface of the container door and an upper position that represents the same projection of the lower position on the inner surface of the container door. A drive mechanism works together with the raising mechanism so that the raising mechanism can be both actuated and stopped.

Published document WO 2014/102374 A1 discloses a dishwasher comprising a washing container and a container door that makes access to the washing container possible, as well as a lower crockery basket and an upper crockery basket in which various objects can be arranged. A holder is provided, by means of which the lower crockery basket can be held on the underside when it is moved out of the interior of the washing container via an inner surface of the container door. The holder also enables the lower crockery basket to be released when it is moved into the washing container over the inner surface of the container door. A raising mechanism is also arranged on the inner surface of the container door which, when the container door is opened, can be activated telescopically in a direction perpendicular to the inner surface of the container door, i.e. can be moved inwards and outwards and which, when the container door is closed, remains coplanar with the inner surface of the container door. The raising mechanism thus enables the holder, together with the lower crockery basket, to move rectilinearly between a lower position on the inner surface of the container door and an upper position. A drive mechanism arranged on the inner surface of the container door works together with the raising mechanism so that the raising mechanism can be both actuated and stopped.

Published document EP 1 066 789 A1 discloses a lifting device for a lower crockery basket of a dishwasher. The dishwasher comprises a washing container with a bottom wall, with a rear wall and with a closable container door at the front. The lifting device comprises two pairs of intersecting levers that are linked to one another along a central line. The upper ends of the levers support the lower crockery basket of the dishwasher and the lower ends of the levers can be actuated by at least one telescopic shaft that is supported from below by a toothed rod that extends horizontally along the bottom wall of the washing container and can be controlled by motorized means.

Published document JP 10/179495 A discloses a dishwasher with a washing container with front opening and with a crockery basket that can be arranged in the washing container. The crockery basket is movably arranged on a supporting platform and the supporting platform is embodied in such a way that it can be moved in a vertical direction together with a crockery basket that is arranged on it.

Published documents WO 2005/104924 A1, U.S. Pat. Nos. 5,115,822 A, 6,247,771 A, JP 2000/000201 A, JP 2001/224547 A, JP 2006/141515 A, JP 2006/141516 A and JP 2006/141526 A disclose further devices for raising a lower crockery basket of a dishwasher.

Removal of the lower rack in domestic dishwashers with such a lower-rack raising means is in practice no longer possible because of the fixed connection of the lower rack to the sliding/pivot mechanism. As a result the container bottom of the washing container can only be accessed with difficulty.

BRIEF SUMMARY OF THE INVENTION

Against this background one object of the present invention consists in making available improved accessibility to a container bottom of a washing container of a domestic dishwasher.

Accordingly, a lower rack for a domestic dishwasher with lower-rack raising means with at least one fixed lower rack element and at least one removable lower rack element is proposed, it being possible for access to a container bottom of a washing container of the domestic dishwasher to be unblocked by the removal of the removable lower rack element.

A modular and separable construction of the lower rack enables full or partial access to the container bottom of the washing container, without the convenience of the lower-rack raising means having to be sacrificed. Furthermore, inspection, maintenance and repair of the domestic dishwasher are simplified.

The lower rack is one of possibly several loading levels of a domestic dishwasher, each of which can serve as a receptacle for items to be washed. The lower rack is located inside the washing container, preferably in a lower position directly above the container bottom of the washing container. The lower rack can comprise a basket-like structure made up of longitudinal and transverse elements that can be formed of wire and/or plastic.

A lower-rack raising means is a sliding/pivoting mechanism that, for greater ease of loading and unloading of items to be washed, allows the lower rack to be raised from its lower position inside the washing container into an upper position outside the washing container.

In the present case "lower" and "upper" are to be understood as meaning that the upper position of the lower rack in a height direction of the domestic dishwasher is envisaged as being above its lower position.

"Fixed" means that the elements in question are joined in such a way that they either cannot be separated or can be separated only with the expenditure of so much time and effort that separating them is excluded as an option for everyday use. Inseparable joints that can be created by, for example, welding, soldering, riveting, vulcanizing and bonding can only be separated by destroying the joining means, while the loosening of screw joints can be too time-consuming and/or difficult or too impractical for everyday use, with the result that screw joints must also be categorized as "fixed".

"Removable", on the other hand, means that the joint between the elements in question can be separated very quickly. Such a joint is therefore suitable for everyday use. Elements that can be removed from one another are, for example, elements that enter into positive mechanical engagement, possibly in conjunction with gravity, for example through the positioning, or suspension, of an element on or in another element, or through the use of fastening means that cause positive mechanical engagement, such as for example snap joints.

Access to the container bottom of the washing container exists when a user or service person finds no obstacle between themselves and this container bottom, i.e. when a free corridor for access exists.

According to a preferred embodiment variant the at least one removable lower rack element is embodied as at least one wire basket and the at least one fixed lower rack element is embodied as a frame that is arranged so as to receive the at least one wire basket.

A wire basket that can be held in the frame, from which it can be removed simply by being grasped, enables practically full access to the container bottom of the washing container when the lower rack is in its lower position directly above the container bottom of the washing container.

The at least one wire basket is preferably a plastic-coated wire rack.

According to a further preferred embodiment variant the frame is embodied as a circumferential frame with or without one or more cross-pieces.

The circumferential frame is a stable form of frame that can, however, be further stiffened by means of optional cross-pieces. Furthermore, the optional cross-pieces can subdivide a capacity area within the circumferential frame into at least two smaller sections, each of which can hold a wire basket.

According to a further preferred embodiment variant the at least one wire basket can be suspended in the frame.

The at least one wire basket preferably has wire hooks provided on its sides with which it can be suspended in the frame. If the frame has optional cross-pieces, the wire hooks may also be suspended on these, provided the at least one wire basket can be held in one of the at least two smaller sections.

According to a further preferred embodiment variant the at least one removable lower rack element is embodied as at least one removable sub-basket and the at least one fixed lower rack element is embodied as at least one fixed sub-basket, and the at least two sub-baskets are arranged so as to be separably fastened directly or indirectly to one another. For the purposes of indirect fastening, both of the two sub-baskets can be fastened to a common rail, with only the removable sub-basket being fastened separably to the rail.

At least one separable sub-basket that can be removed from the at least one fixed sub-basket simply by being grasped enables access to be unblocked, at least to more frequently accessed areas of the container bottom of the washing container, if the lower rack is in its lower position directly above the container bottom of the washing container.

Preferably, both the at least one removable sub-basket and the at least one fixed sub-basket are embodied as wire baskets.

According to a further preferred embodiment variant the at least one removable sub-basket is fastened to a side of the at least one fixed sub-basket that faces the front of the housing of the domestic dishwasher.

It is advisable if more frequently accessed areas of the container bottom of the washing container, for example those in which a reservoir for regenerating salt or a sieve is located, are provided closer to the front of the housing of the domestic dishwasher on the container bottom of the washing container than to the rear wall of the container.

By the removal of this part of the lower rack that faces the front of the housing of the domestic dishwasher and comprises the at least one removable sub-basket, access to an area of the container bottom of a washing container of the domestic dishwasher can be unblocked.

According to a further preferred embodiment variant the lower rack is characterized by mutually corresponding engaging elements and receiving elements provided on a butt between the at least two sub-baskets in a depth direction of the domestic dishwasher and arranged so as to enter into separable positive mechanical engagement with one another in and against the depth direction.

In particular, such mutually corresponding engaging and receiving elements are to be provided here as are easy to operate during everyday use.

It is advisable for these elements to be provided on the butt between the at least two sub-baskets, i.e. on the common interface between the at least two sub-baskets in the depth direction of the domestic dishwasher.

Mutually corresponding engaging and receiving elements means that the engaging element—or in preferred embodiment variants with several engaging elements, each engaging element—is positioned in such a way as to be in alignment with at least one receiving element that corresponds to it.

Engaging and receiving elements are simple to produce. Where they are provided in existing component parts, such as for example wire baskets, time and effort expended on the assembly of the domestic appliance are reduced as a result of the small number of required component parts.

An engaging element is a protrusion or projection that can enter into positive mechanical engagement with a receiving element. Engaging elements can for example be embodied as tabs, hooks, domes, noses or latches.

A receiving element is a recess that can enter into positive mechanical engagement with an engaging element. Examples of receiving elements include slits, slots, holes, pockets or recesses in general, as well, in special cases, as the abovementioned examples of engaging elements. For example, a latch and a nose may also engage with one another if appropriately arranged in relation to one another.

According to a further preferred embodiment variant the mutually corresponding engaging and receiving elements are embodied as a latch and a corresponding nose, it being possible for the latch to be latched onto the nose, or the mutually corresponding engaging and receiving elements are embodied as a hook and a corresponding wire element of the lower rack, into which the hook can be hooked.

Pairs of mutually corresponding engaging and receiving elements that comprise a latch and a nose or a hook and a wire element of the lower rack are in each case able to engage with one another and create the desired separable positive mechanical engagement in and against the depth direction.

It is possible, in particular by means of lever mechanisms provided for the purpose, to release the engagement between mutually corresponding engaging and receiving elements, with for example spring forces, or gravitational forces exerted via levers, having to be overcome.

According to a further preferred embodiment variant the at least one fixed lower rack element is embodied as a wire basket that has at least one recess in its geometry, with the at least one removable lower rack element at least partially covering the at least one recess and, following removal of said lower rack element, access to the container bottom area of the washing container existing through the at least one recess.

The at least one recess in the geometry of the wire basket enables the unblocking of access to certain frequently accessed areas of the container bottom of the washing container that have already been taken into account, in the form of the at least one recess, in the construction of the fixed lower rack element. Where the at least one removable lower rack element wholly or partially covers the at least one recess these areas of the container bottom of the washing container only become accessible if the at least one removable lower rack element is removed.

The geometry of the wire basket constitutes the structural design of the wire basket that gives it shape and stability and is defined in particular by one or more wires of said wire basket.

A recess in the wire basket is in particular a gap or mesh that is produced in the wire basket by no further wire element to further sub-divide the recess being provided between wire elements that are opposite one another and border the recess.

The size of the at least one recess should preferably be such that access to the container bottom area of the washing container is easily possible. By the same token the dimensions of a footprint of the at least one removable lower rack element should preferably be designed to be greater than the dimensions of the at least one recess, so that the at least one removable lower rack element, when placed directly in the wire basket above the at least one recess, cannot fit into said recess. Equally, however, the at least one removable lower rack element can also be placed in other positions within the wire basket such that it only partially overlaps the at least one recess.

According to a further preferred embodiment variant the wire basket geometry comprises a circumferential frame, the inside of which defines the recess.

A circumferential frame around a recess provided within the structure of the wire basket is particularly suitable for imparting additional local stability to this less braced area of the wire basket.

According to a further preferred embodiment variant the at least one removable lower rack element is a cutlery basket, a plate receptacle or a series of spines.

In principle, it is possible to provide removable lower rack elements, each of which is embodied for a specific type of item to be washed. For flat items such as for example plates, these lower rack elements can for example be plate receptacles, or tiltable rows of spines, and for cutlery, an appropriate cutlery basket. Further possible examples are removable lower rack elements for difficult-to-load items to be washed such as wine or champagne glasses.

According to a further preferred embodiment variant the fixed or removable lower rack element has a foldable handle on the side that faces the front of the housing of the domestic dishwasher. As a result, access to the inside of the basket and thus to the functional units mentioned is improved still further.

This preferred embodiment variant can be particularly advantageously combined with each of the abovementioned preferred embodiment variants.

According to a further preferred embodiment variant the at least one removable lower rack element of the lower rack is embodied as a rear wall of the wire basket and the at least one fixed lower rack element of the lower rack is embodied as a wire basket comprising at least one basket bottom, a front wall and two side walls. The removable rear wall of the wire basket can also, of course, only comprise a section of the rear wall of the wire basket. The removable rear wall of the wire basket can be removed either by means of a rotational movement or by means of a combination of at least one translational movement and of at least one rotational movement. In this preferred embodiment variant the lower rack is preferably pulled horizontally out of the washing container of the domestic dishwasher during the removal of the rear wall of the wire basket. As already stated, the lower rack can also have a foldable handle on the side of it that faces the front of the housing of the domestic dishwasher. Also proposed is a domestic dishwasher with a washing container, at least one functional unit provided in an area of the container bottom of the washing container and the lower rack described above, with access to the at least one functional unit existing following removal of the removable lower rack element.

A washing container comprises container side walls, a container rear wall, a container ceiling and the container bottom of a watertight washing chamber in the domestic dishwasher.

One or more functional units that are required for the operation of the domestic dishwasher and to which access is required at regular or irregular intervals are often provided, particularly on the container bottom of the washing container. In domestic dishwashers with lower-rack raising means this access is prevented or impeded by the non-removable lower rack. In domestic dishwashers that have the lower rack with a removable lower rack element this access is possible through the removal of the at least one removable lower rack element provided in each case.

According to a preferred embodiment variant the domestic dishwasher is also characterized by a raising mechanism for raising the lower rack that has at least one rail, with the fixed lower rack element being connected to the at least one rail.

The lower rack with a removable lower rack element is designed in particular for domestic dishwashers with lower-rack raising means (so-called lower rack elevation, or LRE) in which a raising mechanism for raising the lower rack is employed. In such cases, at least one and preferably two rails are provided in order to connect the fixed lower rack element with the raising mechanism and the domestic dishwasher.

According to a further preferred embodiment variant the removable lower rack element is separably joined to the at least one rail or to the fixed lower rack element.

Joints are generally defined as "separable' that can be repeatedly fitted together and separated again through the reversal of their joining process. In the context of removable lower rack elements the term "separable" is, however, aimed rather at joints that can be separated very quickly and are thus suitable for everyday use. Positive engagement joints preferred for this purpose are those created by the engagement with one another of engaging and receiving elements, the engagement of which can be reversed when required through the exertion of force by the user of the domestic dishwasher.

Depending on the construction of the lower rack, the removable lower rack element can be joined to the fixed lower rack element or to the at least one rail that connects the fixed lower rack element with the raising mechanism and the domestic dishwasher.

According to a further preferred embodiment variant the functional unit is a salt reservoir, a hot air exhaust valve, a sieve or a spraying device, in particular a spray arm.

The reservoir for the regenerating salt of a water softening device can also be accessible in the area of the container bottom of the washing container, as can the single or multiple-part sieve of a washing water circuit or also a lower spraying device mounted immediately above the container bottom of the washing container. All these functional units are only accessible with difficulty, in particular in a domestic dishwasher without a removable lower rack element.

Other possible implementations of the invention also include combinations of features or preferred embodiment variants not explicitly mentioned before or described with reference to the exemplary embodiments. At the same time, persons skilled in the art will also add individual aspects in the form of improvements or complements to the particular basic form of the invention.

BRIEF DESCRIPTION OF THE DRAWINGS

Further advantageous embodiments and aspects of the invention are the subject matter of the dependent claims as well as of the exemplary embodiments of the invention described in the following. The invention will also be explained in more detail with reference to preferred embodiment variants and whilst referring to the accompanying figures.

DETAILED DESCRIPTION OF EXEMPLARY EMBODIMENTS OF THE PRESENT INVENTION

In the figures, elements that are the same or have the same function are provided with identical reference signs, unless otherwise stated.

Figure 1:
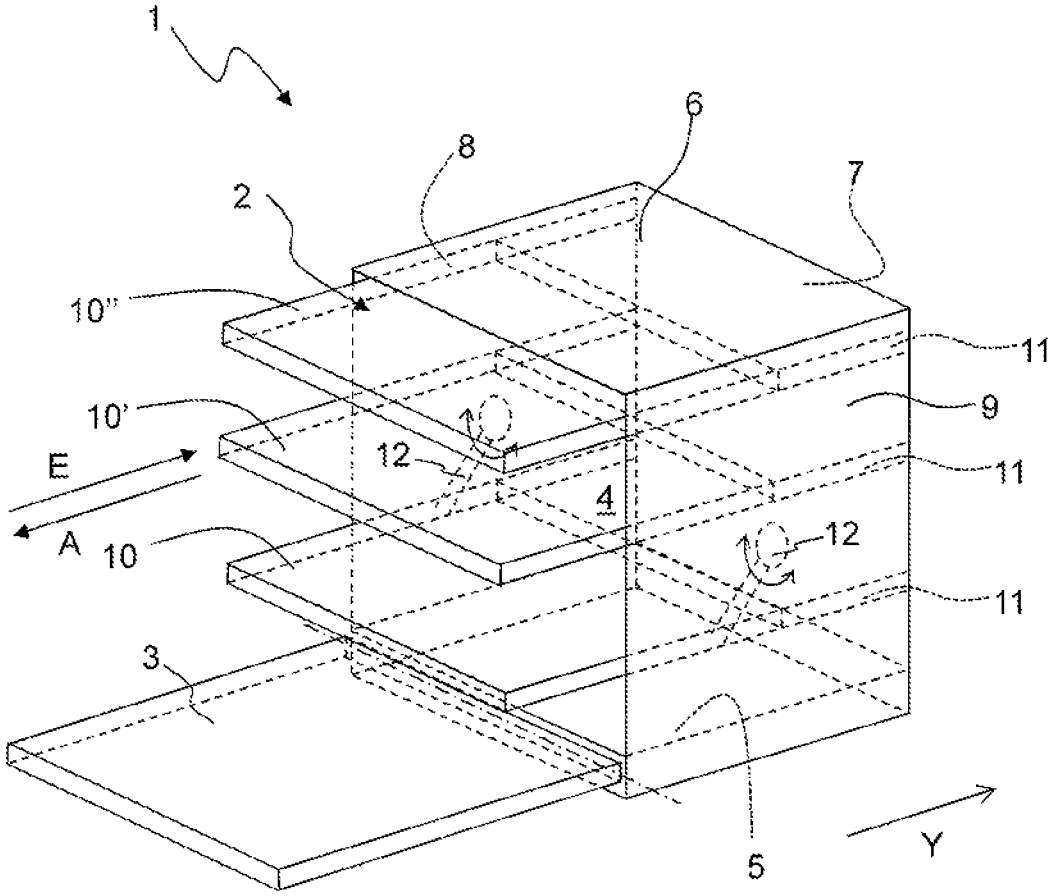
FIG. 1 shows a perspective view of a domestic dishwasher.

FIG. 1 shows a perspective view of a domestic dishwasher 1 with lower-rack raising means. The domestic dishwasher 1 has a carcass comprising a washing container 2 that can be closed by a container door 3 in a watertight manner.

The washing container 2 and the container door 3 can form a washing chamber 4 for the washing of items to be washed. The container door 3 is shown in its opened position in FIG. 1. The container door 3 can be closed or opened by being pivoted about a pivot axis provided on a lower end of the container door 3.

The washing container 2 is for example cuboid and can comprise a container bottom 5, a container ceiling 6 situated opposite the container bottom 5, a container rear wall 7 situated opposite the container door 3 and two container side walls 8, 9 situated opposite one another. The container side walls 8, 9 in particular can be made of stainless steel sheet.

The domestic dishwasher 1 also has at least one loading level 10, 10', 10". The at least one loading level 10, 10', 10" is preferably a receptacle of the domestic dishwasher 1 for items to be washed. In particular, several loading levels, including a lower rack 10, an upper basket 10' and/or a cutlery drawer 10" can be provided. The several loading levels 10, 10', 10" are preferably arranged one above the other in the washing container 2. Each loading level 10, 10', 10" is optionally movable in a push-in direction E into the washing container 2 or out of it in a pull-out direction A. A rail 11 is preferably provided for this purpose on both sides of each of the loading levels 10, 10', 10". In domestic dishwashers 1 with lower-rack raising means the lower rack 10 is fastened to a raising mechanism 12 that comprises the rails 11. The lower rack 10 can be pivoted upwards from its lower position shown in FIG. 1 and out of the washing container 2 by means of the raising mechanism 12. For this purpose, the raising mechanism 12 can have an electric motor and/or be assisted by spring forces or gravitational forces.

Figure 2:
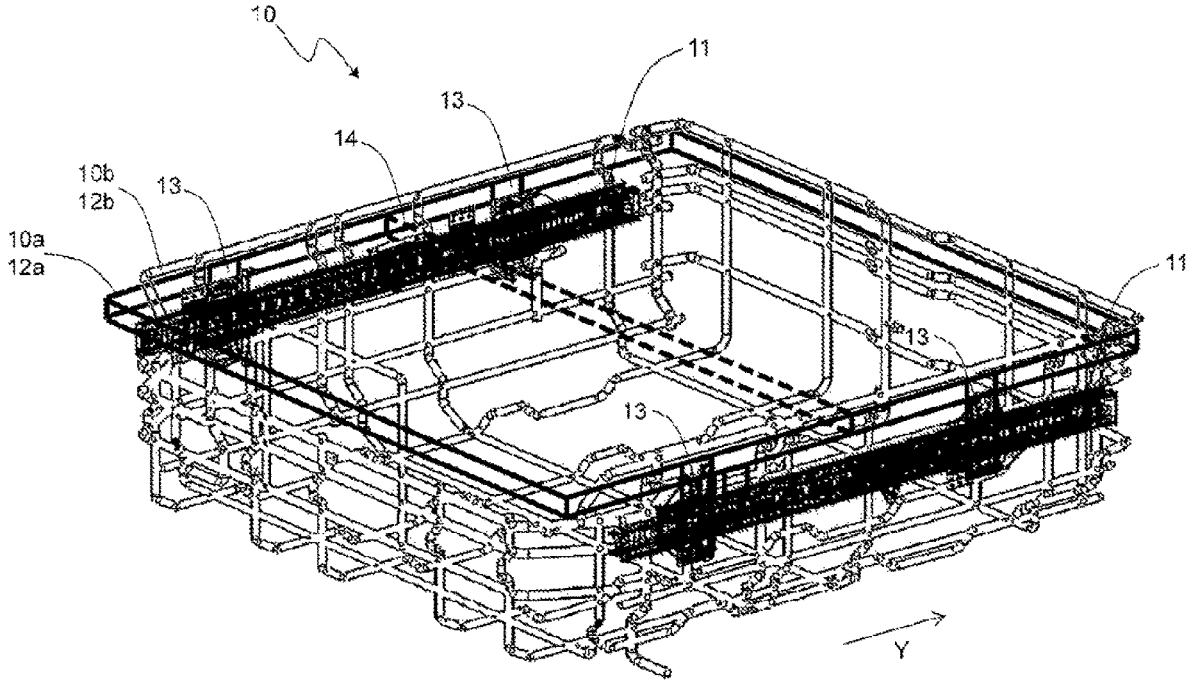
FIG. 2 shows a perspective view of a first preferred embodiment variant of a lower rack.

FIG. 2 shows a perspective view of a first preferred embodiment variant of the lower rack 10.

The lower rack 10 has a frame 12*a* and a wire basket 12*b*. The frame 12*a* serves as a fixed lower rack element 10*a* and, in this preferred embodiment variant of the lower rack 10, is embodied as a circumferential frame that is fastened via several frame holders 13 to the two rails 11 running along the sides of the wire basket 12*b*.

In this preferred embodiment variant the wire basket 12*b* is the removable lower rack element 10*b* of the lower rack 10, which is suspended from above from a height direction Z to enter into positive mechanical engagement with the frame 12*a*.

A possible cross-piece 14 indicated by means of dotted lines could stiffen the frame 12*a* and sub-divide the capacity area of the frame 12*a* into several smaller areas, in each of which a smaller wire basket 12*b* could then be suspended.

When the lower rack 10 is in a lower position in the washing container 2, then pulling the at least one wire basket 12*b* out of the frame 12*a* enables access to the entire container bottom 5 of the washing container 2.

Figure 3:
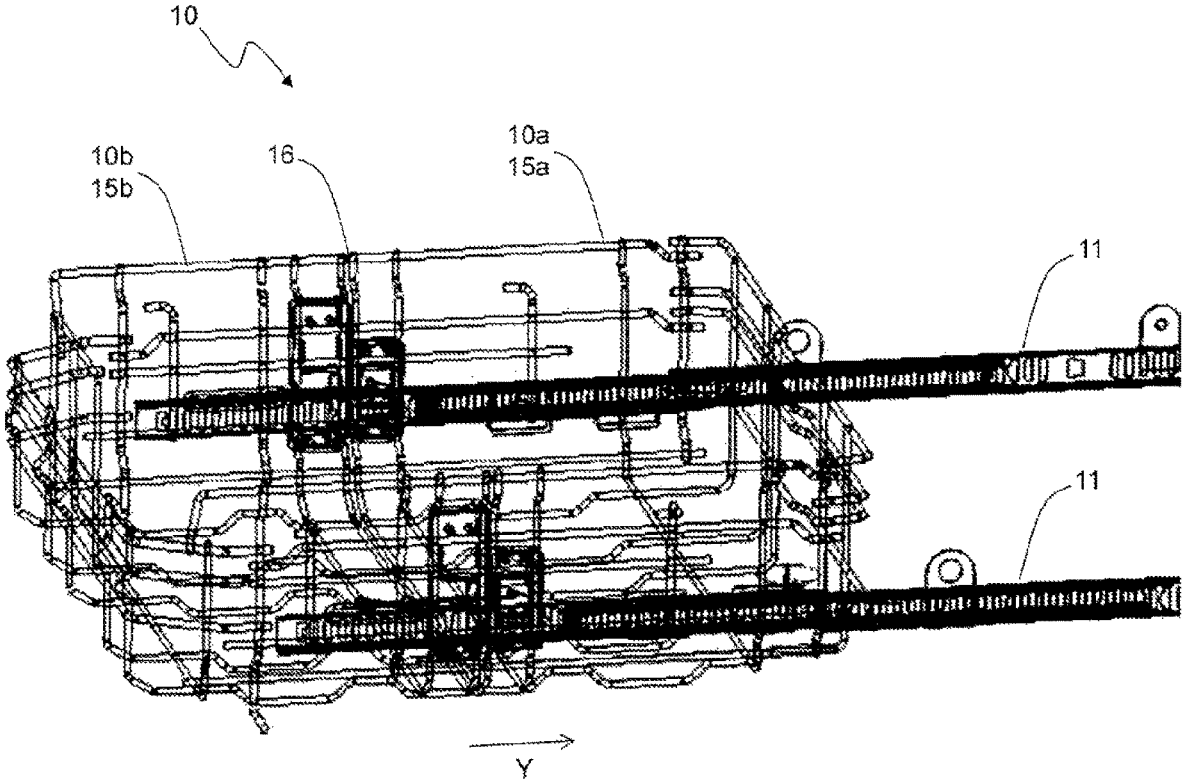
FIGS. 3 and 4 show perspective views of a preferred embodiment variant of the lower rack.
Figure 4:
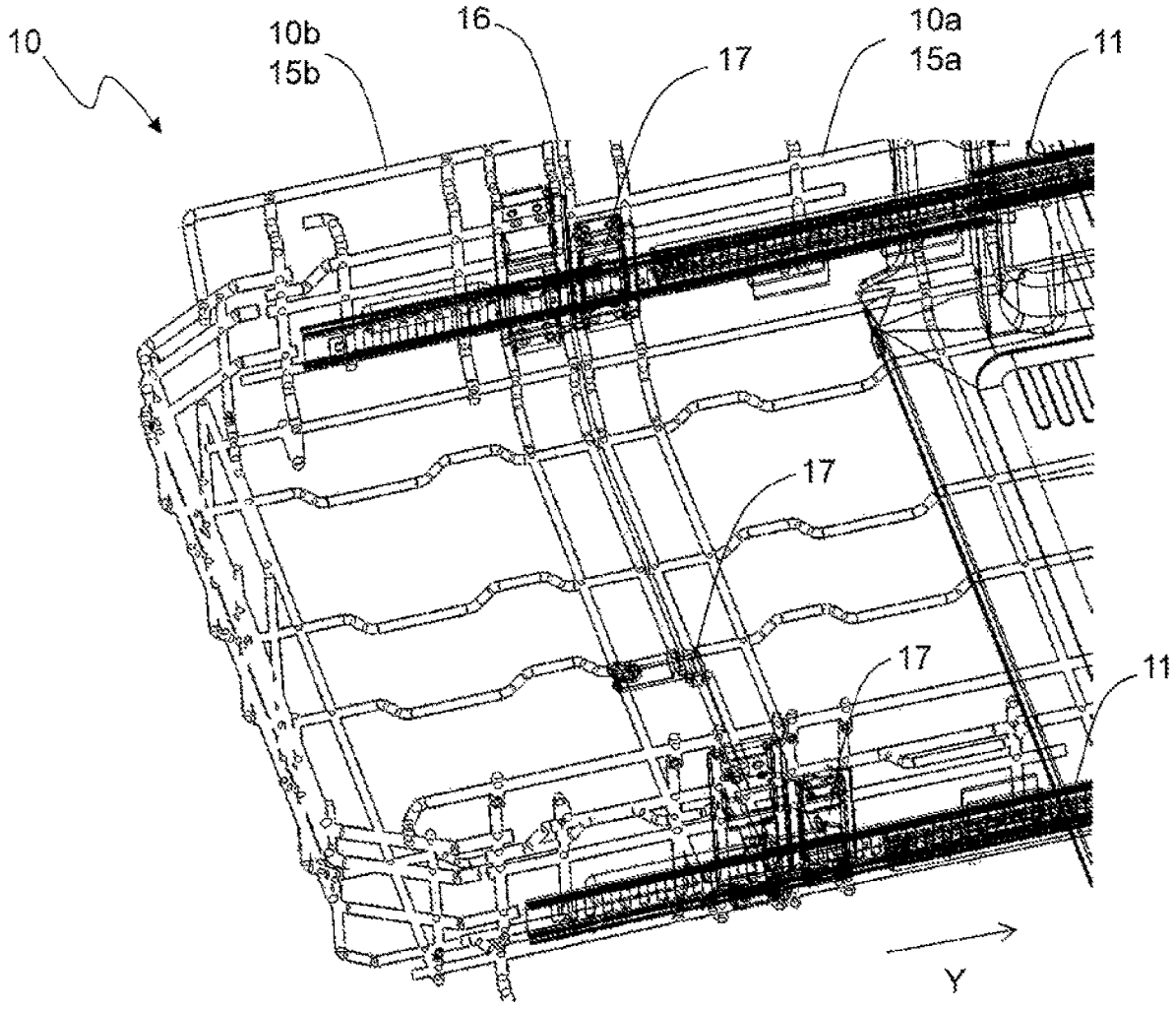

FIG. 3 and FIG. 4 show perspective views of a second preferred embodiment variant of the lower rack 10.

Both figures show a lower rack 10 that comprises a fixed sub-basket 15*a* of the lower rack 10 and a removable sub-basket 15*b* of the lower rack 10, with the removable sub-basket 15*b* being provided in front of the fixed sub-basket 15*a* in a depth direction Y of the domestic dishwasher 1, i.e. on the side of the fixed sub-basket 15*a* that is nearest to the container door 3.

When the lower rack 10 is in its lower position in the washing container 2, then taking the removable sub-basket 15*b* of the lower rack 10 from the fixed sub-basket 15*a* of the lower rack 10 enables access to the front area, of the container bottom 5 of the washing container 2 that faces the container door 3 in the depth direction.

The two sub-baskets 15*a*, 15*b* of the lower rack 10 are in alignment, both in a width direction X and in the height direction Z, and form a butt 16 in the depth direction Y. The sub-basket 15*a* of the lower rack 10 is firmly connected to both of the rails 11 running along the sides of the sub-baskets 15*a*, 15*b*, whereas the sub-basket 15*b* of the lower rack 10 is fastened to the sub-basket 15*a*. This purpose is served in particular by fastening means 17 that can be seen in FIG. 4 and are mounted on the sides and the container bottom 5 of the two sub-baskets 15*a*, 15*b* in such a way that they protrude over the butt 16 between and beyond the two sub-baskets 15*a*, 15*b*, causing positive mechanical engagement between the two sub-baskets 15*a*, 15*b* in and against the depth direction Y.

Figure 5:
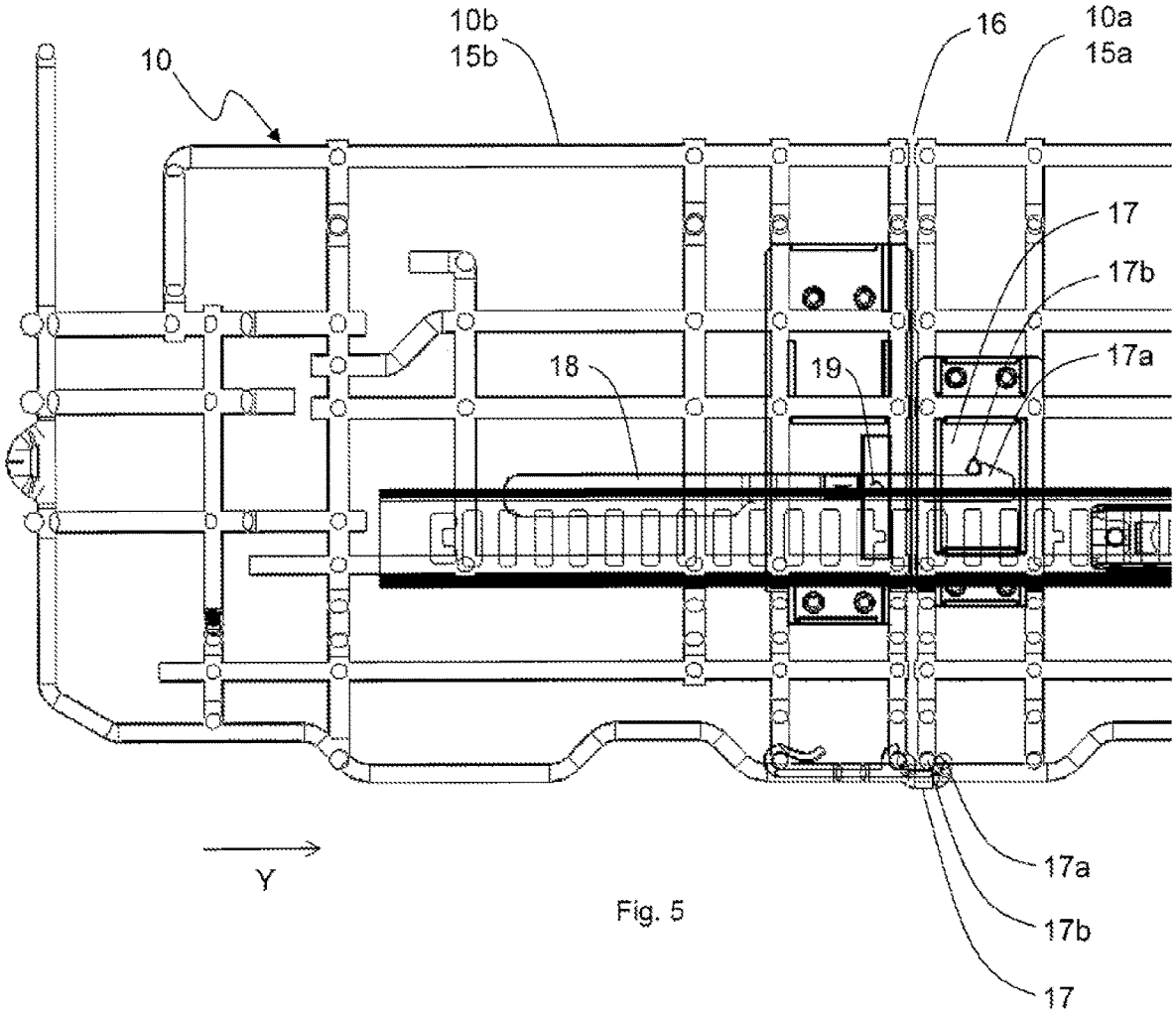
FIG. 5 shows a partial side view of the second preferred embodiment variant.

FIG. 5 shows a partial side view of the second preferred embodiment variant of the lower rack 10 that corresponds to the two previous figures.

It can be seen from FIG. 5 that each of the fastening devices 17 comprises mutually corresponding engaging elements and receiving elements 17*a*, 17*b* that enter into separable positive engagement with one another.

The upper of the two fastening devices 17 that can be seen in FIG. 5 has a latch as its engaging element 17*a*, whereas its receiving element 17*b* is embodied as a nose fastened to the fixed sub-basket 15*a*. The upper fastening device 17 is represented in the latched-in state, in which the latch is in positive mechanical engagement with the nose. A lever 18 that the latch forms at the one end that faces the nose and is fastened to the removable sub-basket 15*b* via a joint 19 is provided for the purpose of reversing the positive mechanical engagement between latch and nose very quickly when required.

The lower of the two fastening devices 17 represented consists of a clip custom made of plastic or metal that comprises a hook 17*a* and a wire element 17*b* of the fixed sub-basket 15*a*. In the fastened state the clip, together with its hook 17*a*, is engaged from below, in a height direction Z, with the wire element 17*b*, i.e. with a mesh of the fixed sub-basket 15*a* of the lower rack 10, and is fixed to the butt 16 in such a way by a further hook that engages with a wire element of the removable sub-basket 15*b* of the lower rack 10 that the bottoms of the two sub-baskets 15*a*, 15*b* are in alignment in the height direction.

Figure 6:
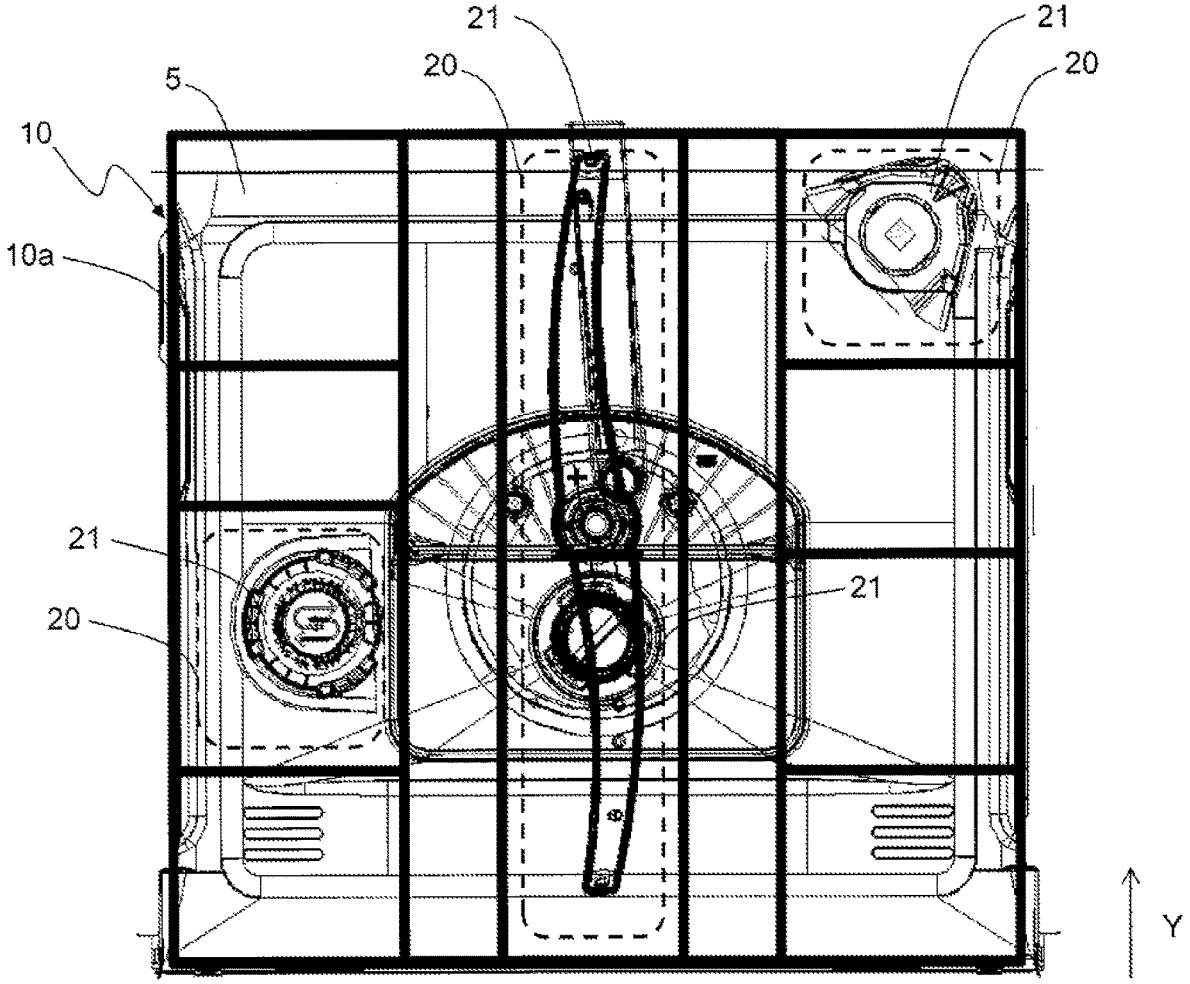
FIGS. 6 and 7 show overhead views of a third preferred embodiment variant of the lower rack.
Figure 7:
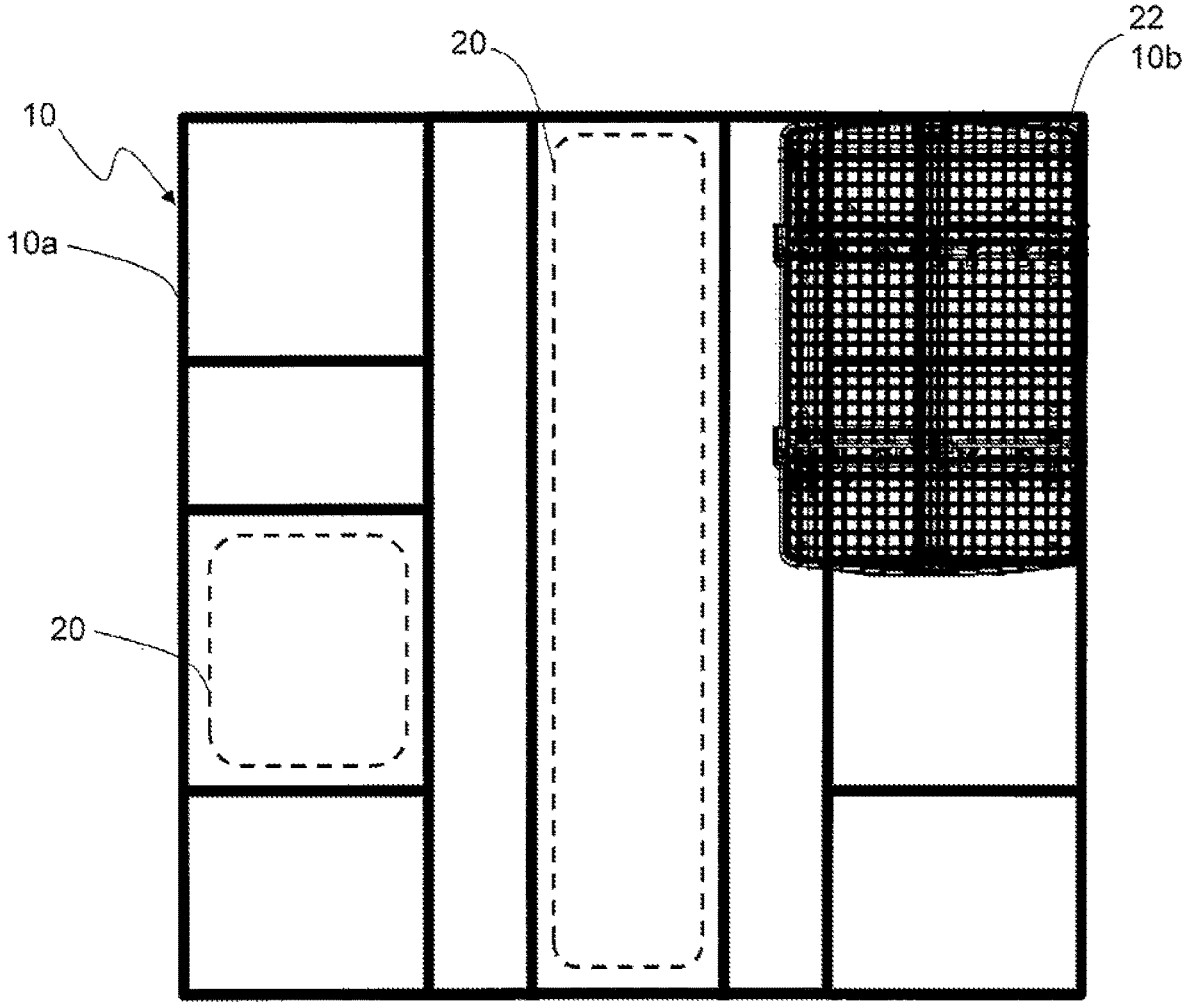

FIG. 6 and FIG. 7 show overhead views of a third preferred embodiment variant of the lower rack 10.

In FIG. 6 the container bottom 5 of the washing container 2 is overlain with a wire geometry of a wire basket 10. Here, the wire geometry provides a series of recesses 20 above certain functional units 21 provided in the container bottom 5. By way of example, a reservoir 21 for the regenerating salt of a water softening device is represented on the left side, a spray arm 21, in generic terms a spraying device, and a fine sieve 21, are represented in the middle and, top right, an exhaust opening 21 for drying air. Each recess 20 is defined in terms of area and position by the wire frame surrounding it, which also stiffens it.

FIG. 7 shows only the wire geometry and the recesses 20 from FIG. 6, as well as a cutlery basket 22 that represents an exemplary removable lower rack element 10*b* of the third preferred embodiment variant. Here, the cutlery basket 22 completely covers the upper right recess 20 that can be seen in FIG. 6 but positions are also possible in which the cutlery basket 22 only partially covers the recess 20 in question, or indeed other recesses 20.

When the lower rack 10 is in its lower position in the washing container 2 then lifting the cutlery basket 22 out of the wire basket 10*a* enables access to the exhaust opening 21 that can be seen in FIG. 6, which is covered in FIG. 7. Generally, the third preferred embodiment variant of the lower rack 10 can enable possibly model-specific access to individual smaller areas of the container bottom 5 of the washing container 2.

Figure 8:
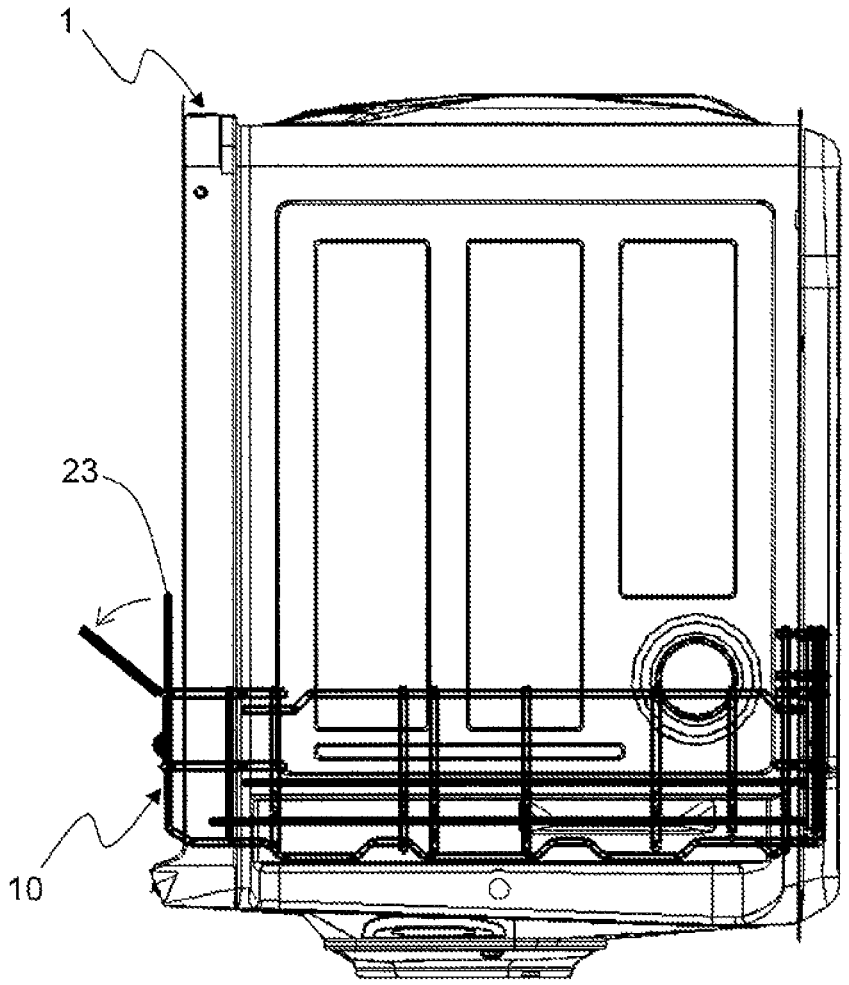
FIG. 8 shows a sectional view of a domestic dishwasher with lower rack.

FIG. 8 shows a side view of the domestic dishwasher 1 with the lower rack 10 in the lower position in the washing container 2.

The container door 3 normally arranged on the left edge of FIG. 8 has been omitted to reveal a handle 23 of the lower rack 10. As indicated in FIG. 8 the latter is pivotably linked to the side of the lower rack 10 that faces the container door 3, in particular to the removable lower rack element 10*b*, 12*b*, 15*b*, 22 to enable it, as an obstacle in an otherwise free corridor between the user and the container bottom 5 of the washing container 2, to be folded.

In the other preferred embodiment variants in FIG. 9A to FIG. 14B the at least one removable lower rack element 10*b* of the lower rack 10 is in each case embodied as a rear wall 24 of the wire basket 12*b* and the at least one fixed lower rack element 10*a* of the lower rack 10 is in each case embodied as a wire basket 12*b* comprising at least one basket bottom 25, a front wall 26 and two side walls 27, 28. The removable rear wall 24 of the wire basket 12*b* can, of course, also only comprise a section of the rear wall of the wire basket.

Figure 9A:
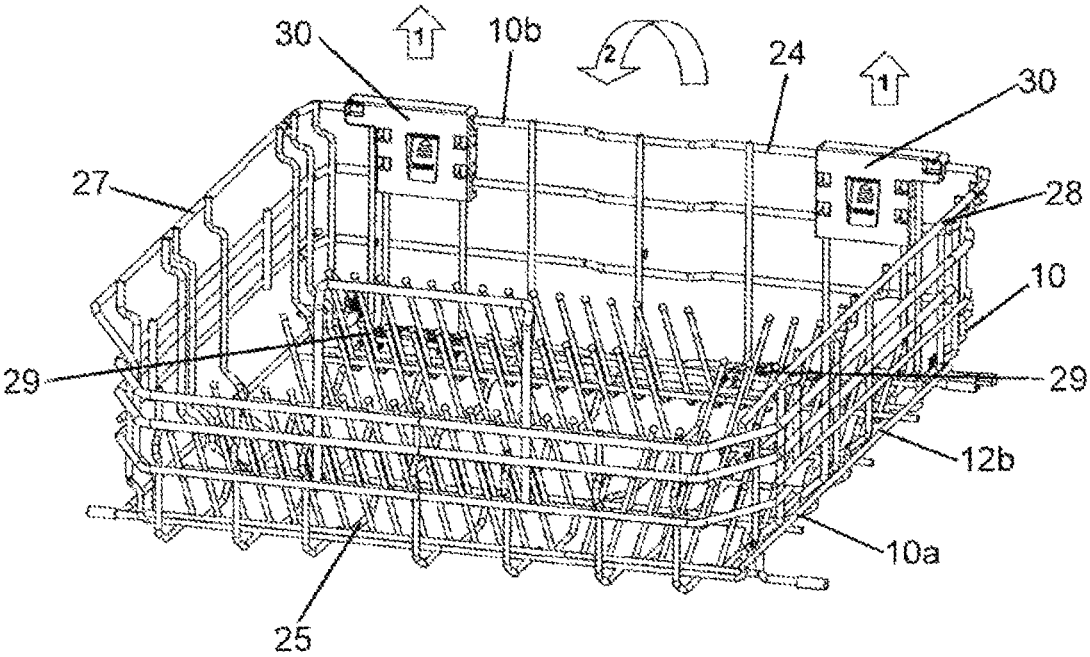
FIGS. 9A and 9B show perspective views of a fourth preferred embodiment variant of the lower rack.
Figure 9B:
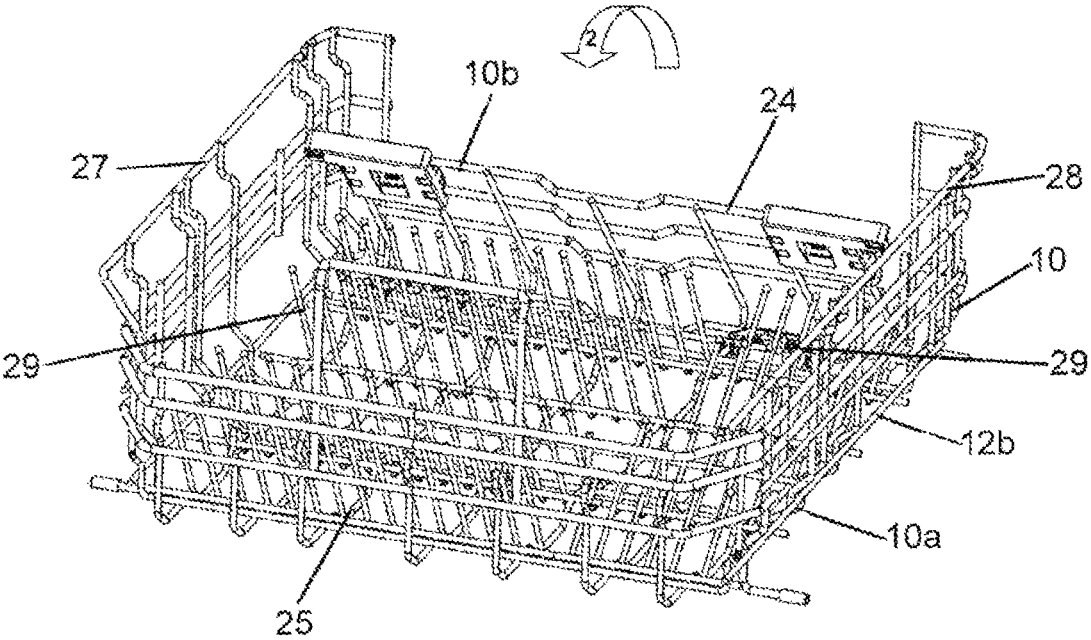

FIG. 9A and FIG. 9B show perspective views of a fourth preferred embodiment variant of the lower rack 10.

The removable rear wall 24 of the wire basket 12*b*, i.e. the removable lower rack element 10*b* of the lower rack 10, is fastened to the underside of the fixed lower rack element 10*a* of the lower rack 10 by means of two basket clips 29. On the upper side the removable rear wall 24 of the wire basket 12*b* is held on the fixed lower rack element 10*a* of the lower rack 10 with two fastening flaps 30. Easier access to the container bottom of the washing container can be achieved through a translational movement of the fastening flaps 30 (arrow "1"), preferably vertically upwards, optionally also together with the rear wall 24, and a subsequent rotational movement of the rear wall 24 (arrow "2", see FIG. 9B) in the direction of the wire basket 12*b*.

Figure 10A:
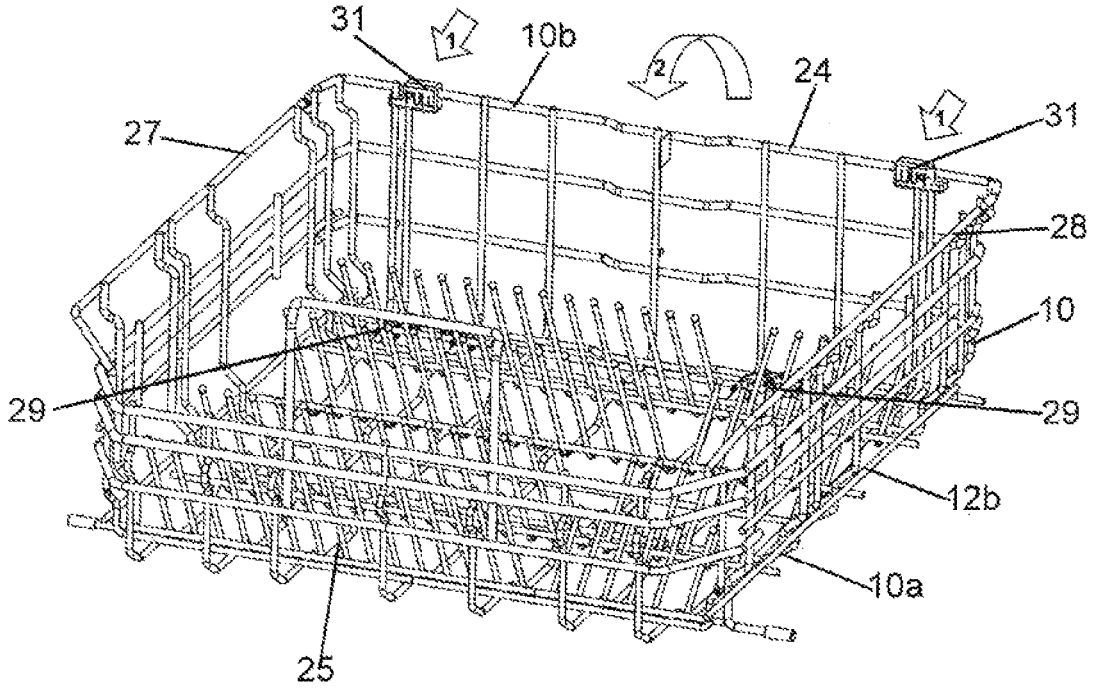
FIGS. 10A and 10B show perspective views of a fifth preferred embodiment variant of the lower rack.
Figure 10B:
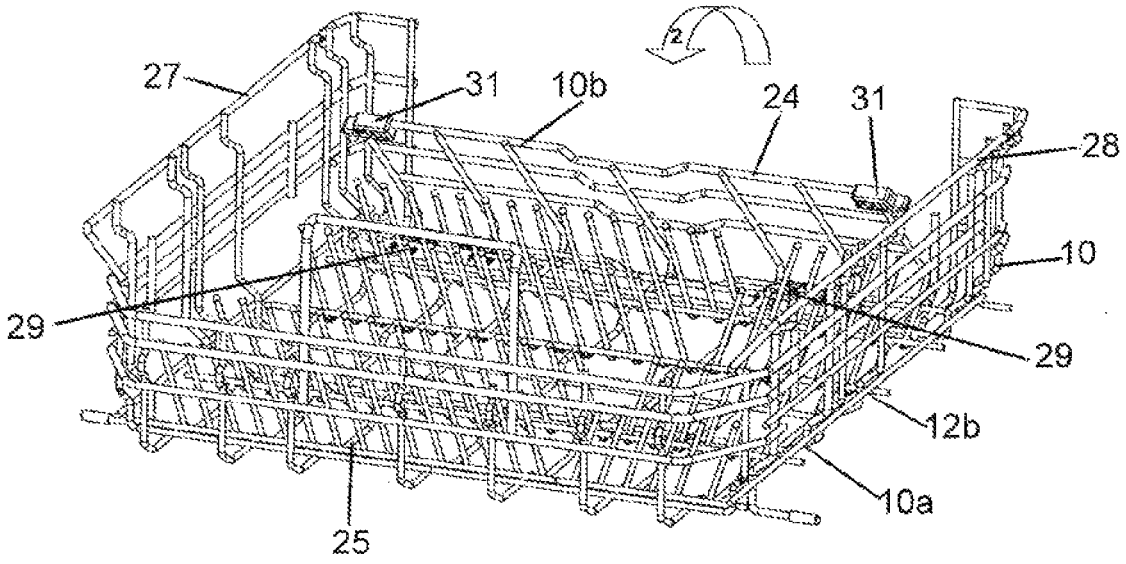

FIG. 10A and FIG. 10B show perspective views of a fifth preferred embodiment variant of the lower rack 10.

The removable rear wall 24 of the wire basket 12*b*, i.e. the removable lower rack element 10*b* of the lower rack 10, is fastened to the underside of the fixed lower rack element 10*a* of the lower rack 10 by means of two basket clips 29. On the upper side the removable rear wall 24 of wire basket 12*b* is held on the fixed lower rack element 10*a* of the lower rack 10 with two locking elements 31. Easier access to the container bottom of the washing container can be achieved through a translational movement of the locking elements 31 (arrow "1"), optionally also together with the rear wall 24, and a subsequent rotational movement of the rear wall 24 (arrow "2", see FIG. 10B) in the direction of the wire basket 12*b*.

Figure 11A:
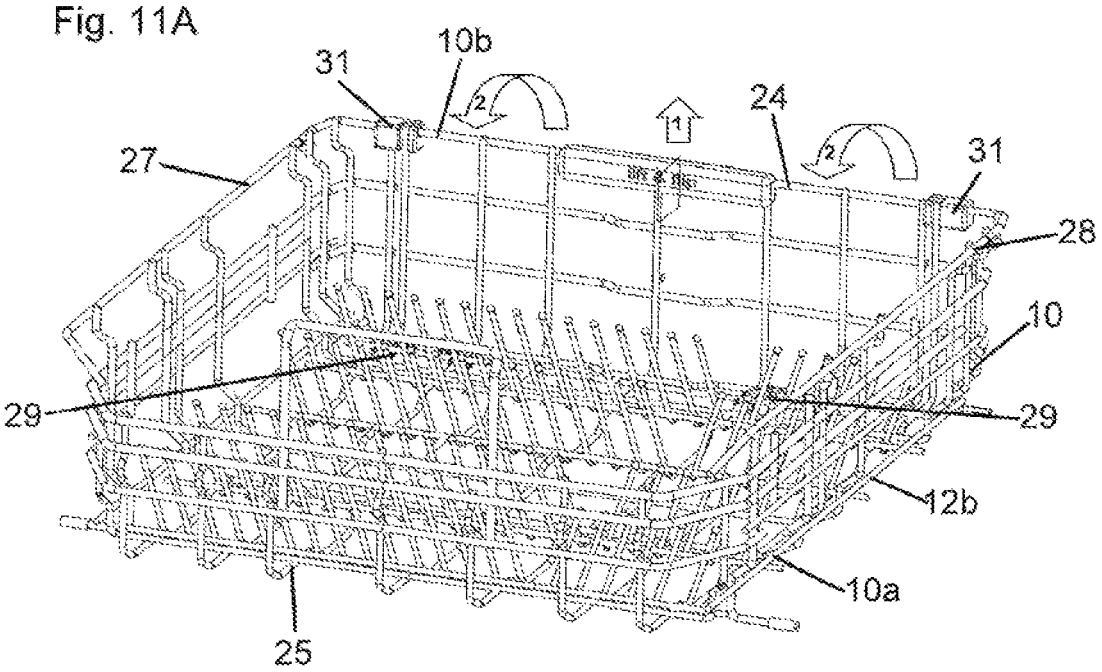
FIG. 11A to 11C show perspective views of a sixth preferred embodiment variant of the lower rack.
Figure 11B:
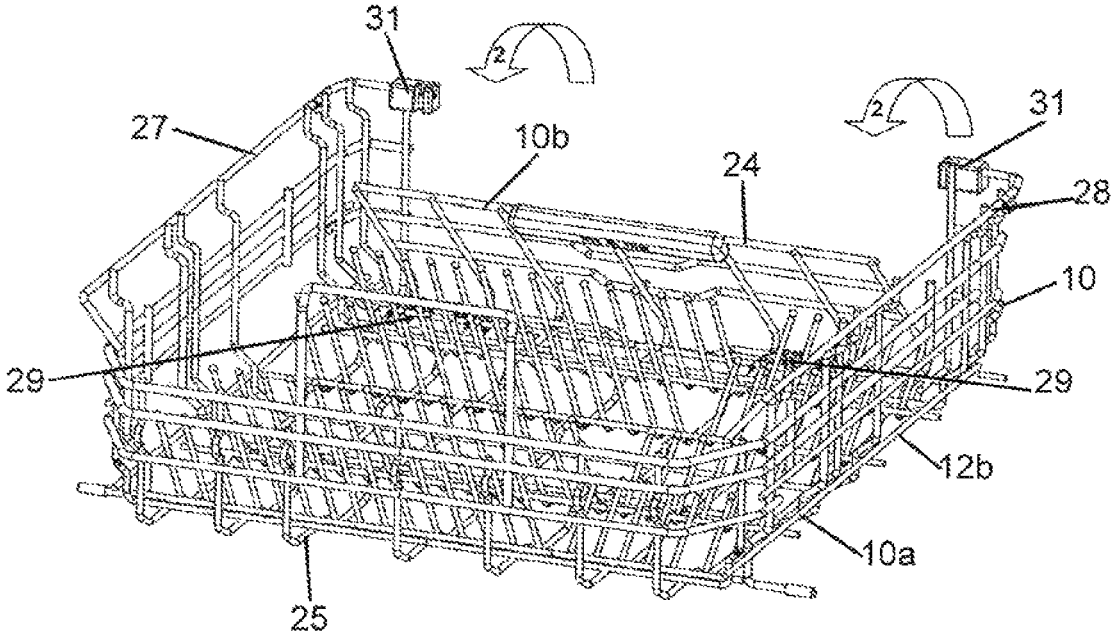
Figure 11C:
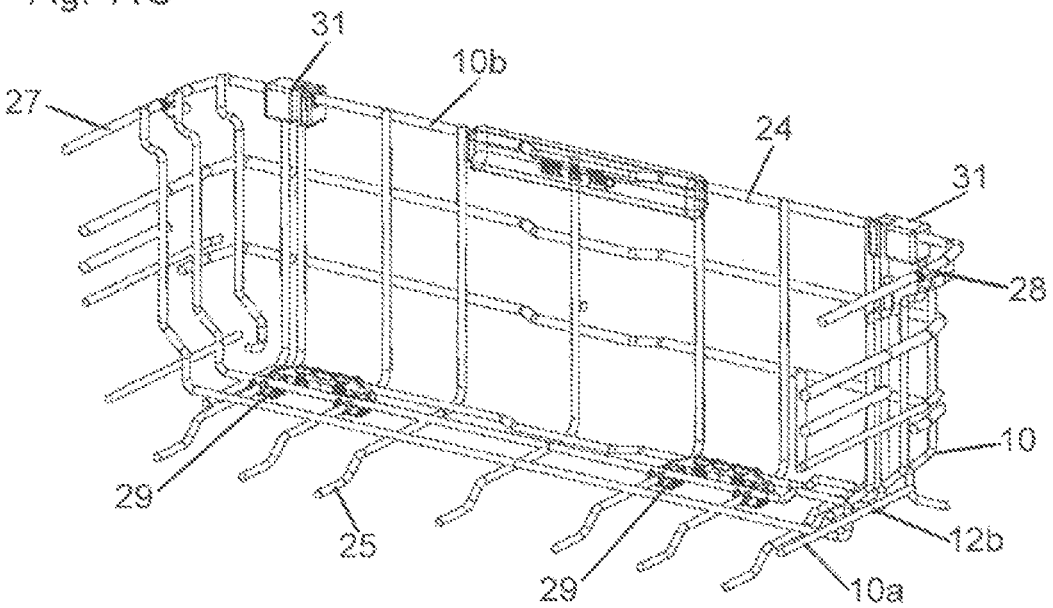

FIG. 11A, FIG. 11B and FIG. 11C show perspective views of a sixth preferred embodiment variant of the lower rack 10.

The removable rear wall 24 of the wire basket 12*b*, i.e. the removable lower rack element 10*b* of the lower rack 10 is fastened to the underside of the fixed lower rack element 10*a* of the lower rack 10 by means of two basket clips 29. On the upper side the removable rear wall 24 of wire basket 12*b* is held on the fixed lower rack element 10*a* of the lower rack 10 with two locking elements 31. Easier access to the container bottom of the washing container can be achieved through a translational movement of the rear wall 24 (arrow "1") and a subsequent rotational movement of the rear wall 24 (arrow "2"; see FIG. 11B) in the direction of the wire basket 12*b*. FIG. 11C shows a cutaway partial view of FIG. 11A.

Figure 12A:
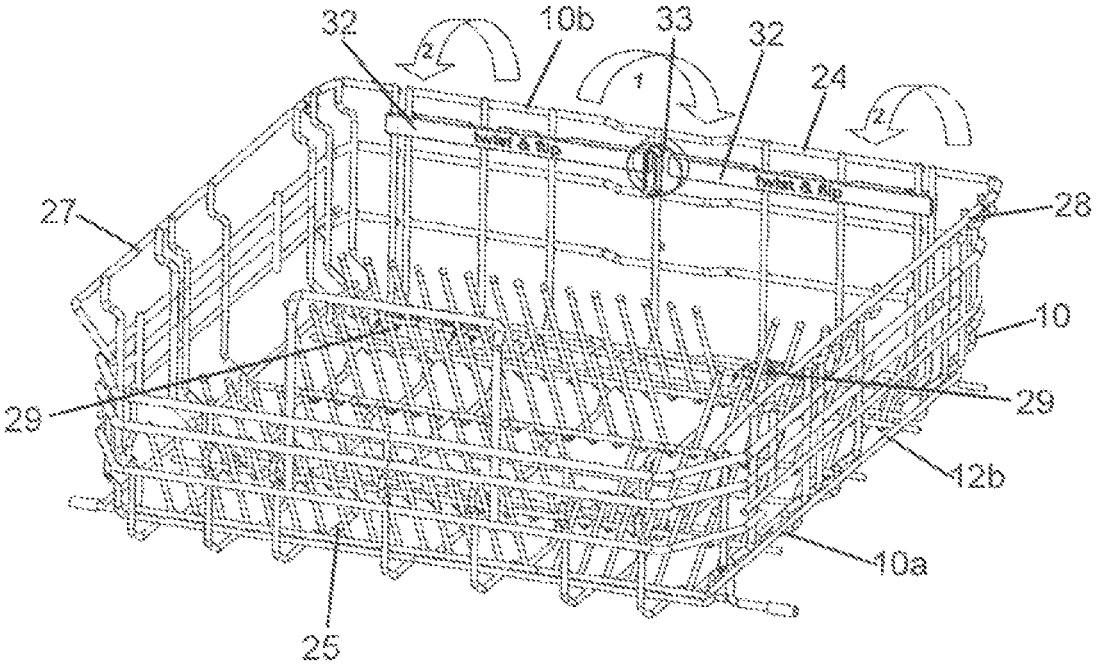
FIG. 12A to 12C show perspective views of a seventh preferred embodiment variant of the lower rack.
Figure 12B:
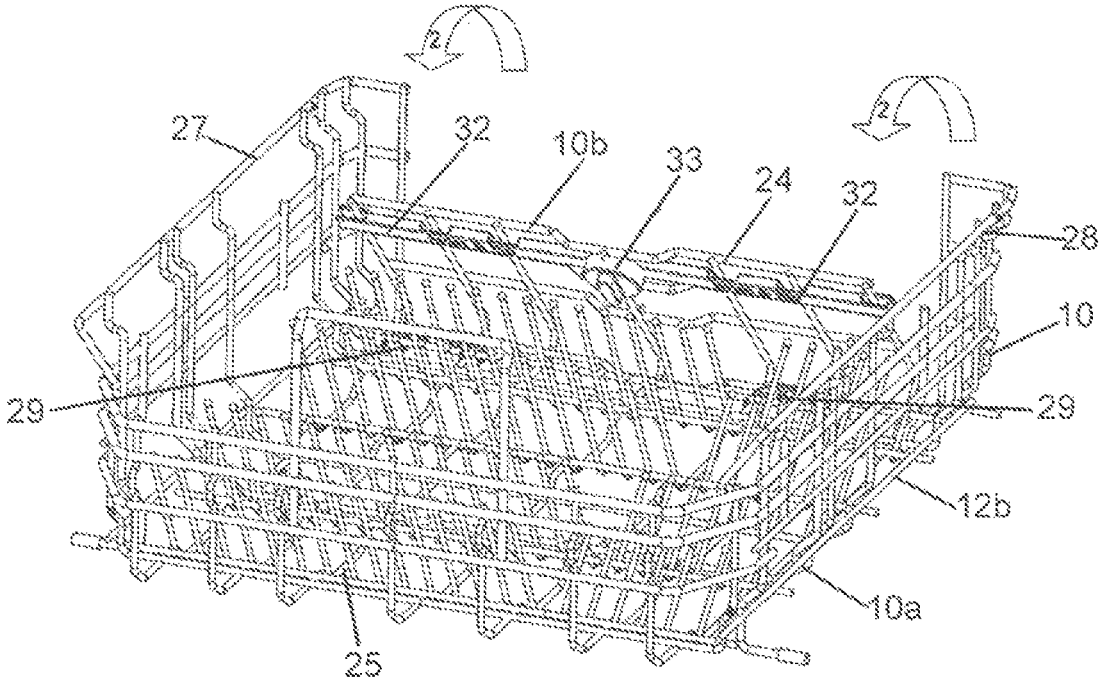
Figure 12C:
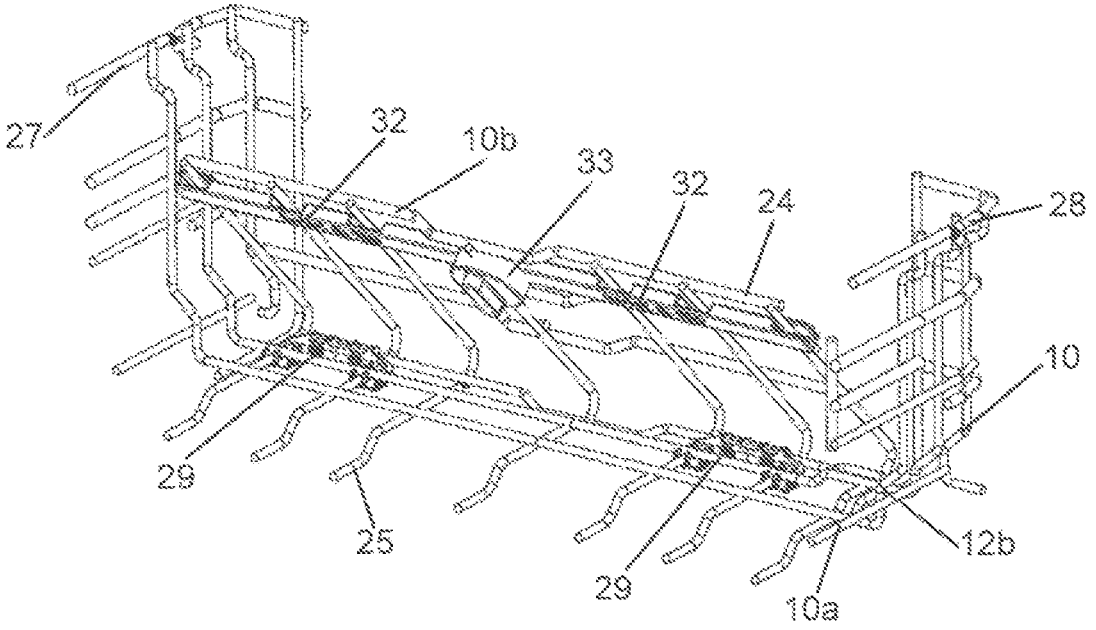

FIG. 12A, FIG. 12B and FIG. 12C show perspective views of a seventh preferred embodiment variant of the lower rack 10.

The removable rear wall 24 of the wire basket 12*b*, i.e. the removable lower rack element 10*b* of the lower rack 10, is fastened to the underside of the fixed lower rack element 10*a* of the lower rack 10 by means of two basket clips 29. On the upper side the removable rear wall 24 of the wire basket 12*b* is held on the fixed lower rack element 10*a* of the lower rack 10 with two stopping strips 32. The two stopping strips 32 can, however, be controlled by a rotary knob 33. The two stopping strips 32 are moved inwards, i.e. towards each other, by a rotational movement, i.e. a turn, of the rotary knob 33. This results in the upper side of the rear wall 24 of the wire basket 12*b* being unfastened. Easier access to the container bottom of the washing container can be achieved with a rotational movement of the rear wall 24 (arrow "2"; see FIG. 12B) in the direction of the wire basket 12*b*. FIG. 12C shows a cutaway partial view of FIG. 12B.

Figure 13A:
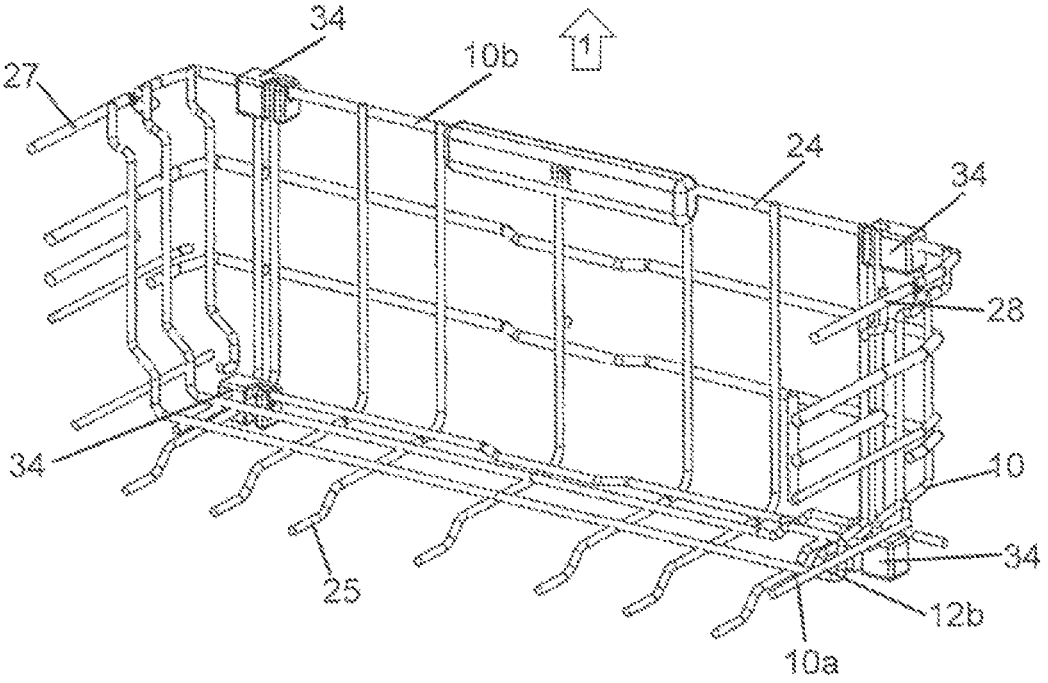
FIGS. 13A and 13B show perspective views of an eighth preferred embodiment variant of the lower rack.
Figure 13B:
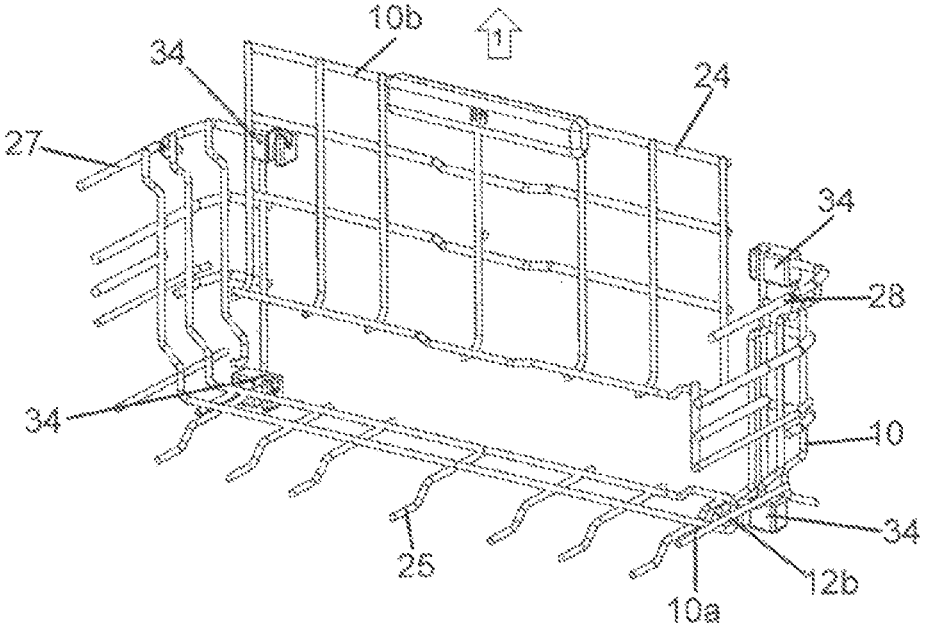

FIG. 13A and FIG. 13B show perspective views of an eighth preferred embodiment variant of the lower rack 10.

The removable rear wall 24 of the wire basket 12*b*, i.e. the removable lower rack element 10*b* of the lower rack 10, is fastened both to the underside and to the upper side of the fixed lower rack element 10*a* of the lower rack 10 by means of two fixing elements 34 in each case. Easier access to the container bottom of the washing container can be achieved through a preferably vertical translational movement of the rear wall 24 (arrow "1").

Figure 14A:
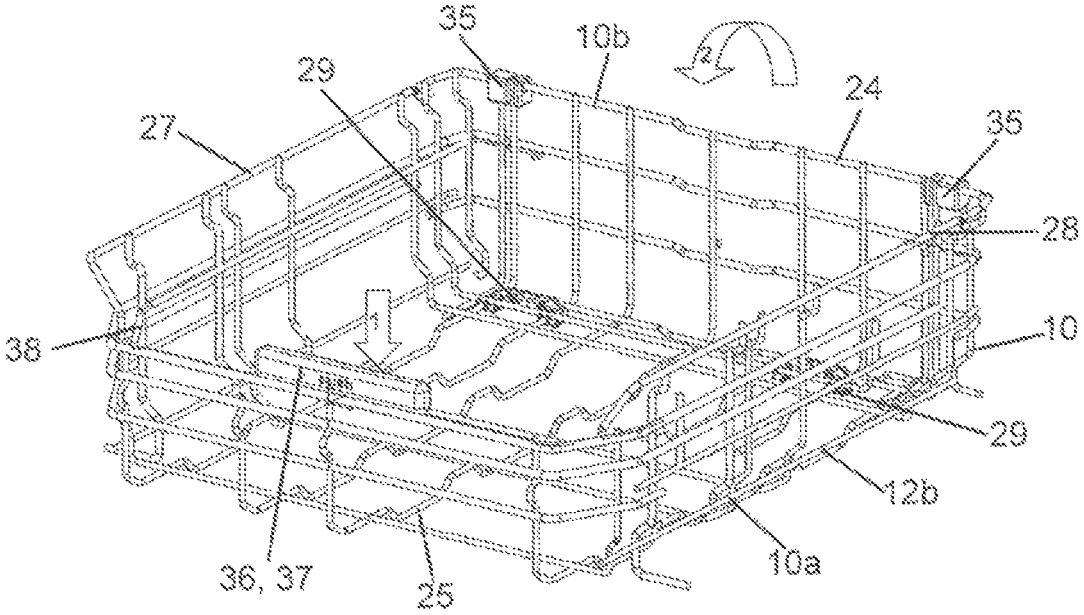
FIGS. 14A and 14B show perspective views of a ninth preferred embodiment variant of the lower rack.
Figure 14B:
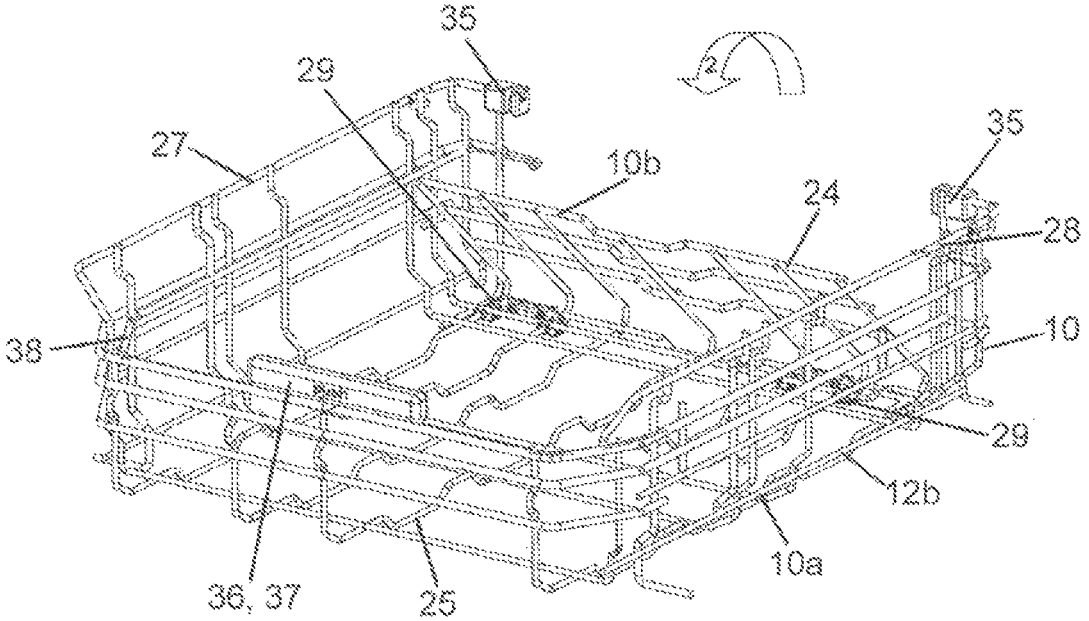

FIG. 14A FIG. 14B show perspective views of a ninth preferred embodiment variant of the lower rack 10.

The removable rear wall 24 of the wire basket 12*b*, i.e. the removable lower rack element 10*b* of the lower rack 10 is fastened to the underside of the fixed lower rack element 10*a* of the lower rack 10 by means of two basket clips 29. On the upper side the removable rear wall 24 of wire basket 12*b* is held on the fixed lower rack element 10*a* of the lower rack 10 with two prestressed, preferably spring-loaded, fixing elements 35 on the fixed lower rack element 10*a* of the lower rack 10. On the front side of the lower rack 10, on its front wall 26, an operating element 36, preferably an actuable handle element 37, is provided that, when actuated via mechanical, electrical and/or fluidic transmission means 38, for example in the form of a cord, a Bowden cable or the like, exerts pressure on the two prestressed fixing elements 35 and in so doing releases the removable rear wall 24 of the wire basket 12*b* in the direction of the wire basket 12*b*. Easier access to the container bottom of the washing container can be achieved through a rotational movement of the rear wall 24 (arrow "2"; see FIG. 14B) in the direction of the wire basket 12*b*.

In the preferred embodiment variant of FIG. 9A to FIG. 14B the lower rack 10 is preferably pulled horizontally out of the washing container of the domestic dishwasher during the removal of the rear wall 24 of the wire basket 12*b*. The lower rack 10 can also have a foldable handle (see FIG. 8) on the side of it that faces the front of the housing of the domestic dishwasher.

Although the present invention has been described with the aid of exemplary embodiments it can be modified in many different ways.

The invention claimed is:

1. A liftable lower rack for a domestic dishwasher having a washing container, the liftable lower rack comprising:

a fixed lower rack element comprising a frame fixedly mounted to a pair of rail assemblies;

an electric motor driven lifting mechanism configured to raise the fixed lower rack element from a lower position inside the washing container into an upper position outside the washing container while maintaining the frame in a horizontal position; and a removable lower rack element connectable to the fixed lower rack element and constructed for complete removal from the fixed lower rack element to thereby unblock access to a bottom area of the washing container of the domestic dishwasher on condition that the fixed lower rack element is in the lower position inside the washing container.

2. The lower rack of claim 1, wherein the removable lower rack element is embodied as a wire basket, said frame being configured to receive the wire basket.

3. The lower rack of claim 2, wherein the frame is embodied as a circumferential frame.

4. The lower rack of claim 3, further comprising at least one cross-piece to subdivide the circumferential frame.

5. The lower rack of claim 2, wherein the wire basket is configured for suspension in the frame.

6. The lower rack of claim 1, wherein the removable lower rack element is embodied as a removable sub-basket and the fixed lower rack element is embodied as a fixed sub-basket, said removable and fixed sub-baskets being separably fastened directly or indirectly to one another.

7. The lower rack of claim 6, wherein the removable sub-basket is fastened to the fixed sub-basket at a side which faces a front of a housing of the domestic dishwasher.

8. The lower rack of claim 7, further comprising mutually corresponding engaging and receiving elements provided on a butt between the removable and fixed sub-baskets in a depth direction of the domestic dishwasher and constructed to form a separable positive mechanical engagement with one another in and against the depth direction.

9. The lower rack of claim 8, wherein the engaging and receiving elements are embodied in one of two ways, a first way in which the engaging and receiving elements are embodied as a latch and a corresponding nose, with the latch being configured for latching onto the nose, a second way in which the engaging and receiving elements are embodied as a hook and a corresponding wire element of one of the removable and fixed sub-baskets, said hook being configured for hooking into the wire element of the one of the removable and fixed sub-baskets.

10. The lower rack of claim 1, wherein the fixed lower rack element is embodied as a wire basket defined by a wire basket geometry having a recess, said removable lower rack element sized to at least partially cover the recess and, when removed, unblocks the access to the bottom area of the washing container through the recess.

11. The lower rack of claim 10, wherein the wire basket geometry includes the frame embodied as a circumferential frame having an inside configured to form the recess.

12. The lower rack of claim 10, wherein the lower rack element is a cutlery basket, a plate receptacle or a series of spines.

13. The lower rack of claim 2, wherein the removable lower rack element includes a rear wall, a front wall, and two side walls of the wire basket.

14. The lower rack of claim 13, wherein the rear wall of the wire basket of the removable lower rack element is removable via a rotational movement.

15. The lower rack of claim 13, wherein the rear wall of the wire basket of the removable lower rack element is removable via a combination of a translational movement and a rotational movement.

16. A domestic dishwasher, comprising:

a washing container;

a functional unit provided in a container bottom of the washing container;

a lower rack including a fixed lower rack element comprising a frame fixedly mounted to a pair of rail assemblies, and a removable lower rack element constructed for complete removal to thereby unblock access to the functional unit on condition that the fixed lower rack element is inside the washing container; and an electric motor driven raising mechanism configured to raise the lower rack from a lower position inside the washing container into an upper position outside the washing container while maintaining the lower rack in a horizontal position.

17. The domestic dishwasher of claim 16, wherein the removable lower rack element is separably joined to the fixed lower rack element.

18. The domestic dishwasher of claim 16, wherein the functional unit is a salt reservoir, a hot air exhaust valve, a sieve or a spraying device.

19. The domestic dishwasher of claim 18, wherein the spraying device is a spray arm.

* * * * *